US009616481B2

(12) United States Patent
Okuda

(10) Patent No.: US 9,616,481 B2
(45) Date of Patent: Apr. 11, 2017

(54) HOT STAMPING DEVICE

(71) Applicant: FUTABA INDUSTRIAL CO., LTD., Okazaki-shi, Aichi (JP)

(72) Inventor: Yoshimi Okuda, Okazaki (JP)

(73) Assignee: Futaba Industrial Co., Ltd., Okazaki-shi (JP)

( * ) Notice: Subject to any disclaimer, the term of this patent is extended or adjusted under 35 U.S.C. 154(b) by 0 days.

(21) Appl. No.: 14/759,634

(22) PCT Filed: Dec. 20, 2013

(86) PCT No.: PCT/JP2013/084319
§ 371 (c)(1),
(2) Date: Jul. 7, 2015

(87) PCT Pub. No.: WO2014/109213
PCT Pub. Date: Jul. 17, 2014

(65) Prior Publication Data

US 2015/0343513 A1 Dec. 3, 2015

(30) Foreign Application Priority Data

Jan. 11, 2013 (JP) ..... 2013-003722

(51) Int. Cl.
*B21D 28/00* (2006.01)
*B21D 28/14* (2006.01)
(Continued)

(52) U.S. Cl.
CPC ..... *B21D 28/14* (2013.01); *B21D 22/208* (2013.01); *B21D 24/16* (2013.01); *B21D 35/001* (2013.01); *B21D 37/16* (2013.01)

(58) Field of Classification Search
CPC ..... B21D 37/02; B21D 37/04
See application file for complete search history.

(56) References Cited

U.S. PATENT DOCUMENTS 3,759,169 A * 9/1973 Goodley ..... B65B 13/02 100/26
5,271,698 A * 12/1993 Heredia ..... B23C 3/35 409/82
9,050,641 B2 * 6/2015 Cho ..... B21D 22/208

FOREIGN PATENT DOCUMENTS

CN 102527838 * 3/2012 ..... B21D 37/04
CN 202192152 * 4/2012 ..... B21D 37/02
(Continued)

OTHER PUBLICATIONS

The American Heritage Dictionary, https://www.ahdictionary.com/word/search.html?q=stamp, search "stamp" (PDF attached).*
(Continued)

*Primary Examiner* — David Bryant
*Assistant Examiner* — Joseph Finan, Jr.
(74) *Attorney, Agent, or Firm* — Withrow & Terranova, P.L.L.C.; Vincent K. Gustafson

(57) ABSTRACT

A switching unit is capable of switching in a stepwise manner a relative position of a second die with respect to a cutting member in an approaching-and-separating direction. A restriction member abuts on the second die and restricts a position of the second die with respect to a movable body in the approaching-and-separating direction. A driving unit changes a position of the restriction member with respect to the second die, and switches an abutment state of the restriction member with respect to the second die. A level difference is formed on a surface on a side of the restriction member facing to the second die, and/or on a surface on a side of the second die facing to the restriction member.

7 Claims, 13 Drawing Sheets

(51) Int. Cl.

| | |
|---|---|
| ***B21D 24/16*** | (2006.01) |
| ***B21D 22/20*** | (2006.01) |
| ***B21D 37/16*** | (2006.01) |
| ***B21D 35/00*** | (2006.01) |

(56) References Cited

FOREIGN PATENT DOCUMENTS

| | | | | | |
|---|---|---|---|---|---|
| CN | 202192152 | U | * | 4/2012 | ..... B21D 37/04 |
| JP | H02-1515 | U | | 8/1990 | |
| JP | H08-090093 | A | | 4/1996 | |
| JP | H09-122783 | A | | 5/1997 | |
| JP | H09-192751 | A | | 7/1997 | |
| JP | 2007-260740 | A | | 10/2007 | |
| JP | 2007-283332 | A | | 11/2007 | |
| JP | 2011-092946 | A | | 5/2011 | |
| JP | 2011092946 | A | * | 5/2011 | ..... B21D 24/00 |
| WO | 2011/039730 | A1 | | 4/2011 | |

OTHER PUBLICATIONS

English Translation of International Preliminary Report on Patentability for International Application No. PCT/JP2013/084319 (Form PCT/IPEA/409), established Jul. 11, 2015, 5 pages.

Notification of Transmittal of the International Preliminary Report on Patentability for International Application No. PCT/JP2013/084319 (Form PCT/IB/338), mailed Jul. 16, 2015, 1 page.

International Search Report for International Application No. PCT/JP2013/084319 (Form PCT/ISA/210), mailed Mar. 11, 2014, 2 pages.

Written Opinion for International Application No. PCT/JP2013/084319 (Form PCT/IPEA/409), mailed Apr. 7, 2015 , 8 pages.

Extended European Search Report for European Patent Application No. 13870856.5, mailed Aug. 12, 2016 (7 pages).

Notice of Reason(s) for Rejection (Office Action) for Japanese Patent Application No. 2014-556368, mailed Jan. 26, 2016, 5 pages (including English translation).

* cited by examiner

HOT STAMPING DEVICE

CROSS-REFERENCE TO RELATED APPLICATIONS

This application is a 35 U.S.C. §371 national phase filing of International Application No. PCT/JP2013/084319, filed Dec. 20, 2013, and claims the benefit of Japanese Patent Application No. 2013-3722 filed Jan. 11, 2013 in the Japan Patent Office. The entire disclosures of International Application No. PCT/JP2013/084319 and Japanese Patent Application No. 2013-3722 are hereby incorporated by reference herein in their respective entireties.

TECHNICAL FIELD

The present invention relates to a hot stamping device.

BACKGROUND ART

A hot-stamping working (hot press working) has been known, in which a metallic material is heated to its hardening temperature, and the heated metallic material in a high-temperature state is worked. Patent Document 1 describes a hot-stamping working in which a molding process and a cutting-and-removing process is sequentially performed. Specifically, in the configuration described in Patent Document 1, a movable spacer is disposed to be switchable between an interposed position at which the movable spacer is interposed between a back support part and an upper die, and a removed position at which the movable spacer is removed from the back support part and the upper die.

PRIOR ART DOCUMENTS

Patent Documents

Patent Document 1: Japanese Unexamined Patent Application Publication No. 2011-92946

SUMMARY OF THE INVENTION

Problems to be Solved by the Invention

In the configuration described in Patent Document 1, it is relatively easy to move the movable spacer from the interposed position to the removed position. However, it is not structurally easy to move the movable spacer from the removed position to the interposed position.

In one aspect of the present invention, it is desirable that a position of a die can be easily switched.

Means for Solving the Problems

One aspect of the present invention is a hot stamping device for performing hot stamping of a metallic material. The hot stamping device comprises: a first die; a movable body that is relatively movable to the first die in an approaching-and-separating direction; a second die that is supported by the movable body and that performs a molding process on the metallic material in cooperation with the first die; a cutting member that is supported by the movable body and that performs a cutting-and-removing process on the metallic material in cooperation with the first die; and a switching unit that is capable of switching in a stepwise manner a relative position of the second die with respect to the cutting member in the approaching-and-separating direction. The switching unit comprises: a restriction member that abuts on the second die and that restricts a position of the second die with respect to the movable body in the approaching-and-separating direction; and a driving unit that changes a position of the restriction member with respect to the second die, and that switches an abutment state of the restriction member with respect to the second die. A level difference is formed on at least one of a surface on a side of the restriction member, the side of the restriction member facing to the second die, and a surface on a side of the second die, the side of the second die facing to the restriction member.

According to the above configuration, switching of the abutment state of the restriction member with respect to the second die enables to switch, in a stepwise manner, the relative position of the second die with respect to the cutting member. Thus, compared with a configuration in which the restriction member is returned to the original position after having been completely separated from the second die, the position of the restriction member with respect to the second die can be easily changed. In addition, a moving amount of the restriction member can be made smaller.

In the aforementioned hot stamping device, the switching unit may be capable of switching the relative position of the second die with respect to the cutting member in the approaching-and-separating direction, among more than three levels. According to this configuration, a more complex process can be performed in a short period of time.

In the aforementioned hot stamping device, the level difference may be formed on both of the surface on the side of the restriction member, the side of the restriction member facing to the second die, and the surface on the side of the second die, the side of the second die facing to the restriction member. According to this configuration, the abutment state of the second die and the restriction member can be made stable.

EXPLANATION OF REFERENCE NUMERALS

1,5,6,7 . . . hot stamping device, 2,51 . . . fixed part, 3,52 . . . movable part, 4,53 . . . servomotor, 9 . . . metal plate, 21,511 . . . lower die, 31,54,64,74 . . . pad, 32,522 . . . cutting blade, 33,523 . . . holder, 34,55,65,75 . . . liner, 35,525 . . . automation equipment

MODE FOR CARRYING OUT THE INVENTION

Hereinafter, embodiments to which the present invention is applied will be described with reference to the drawings.

First Embodiment

Figure 1:
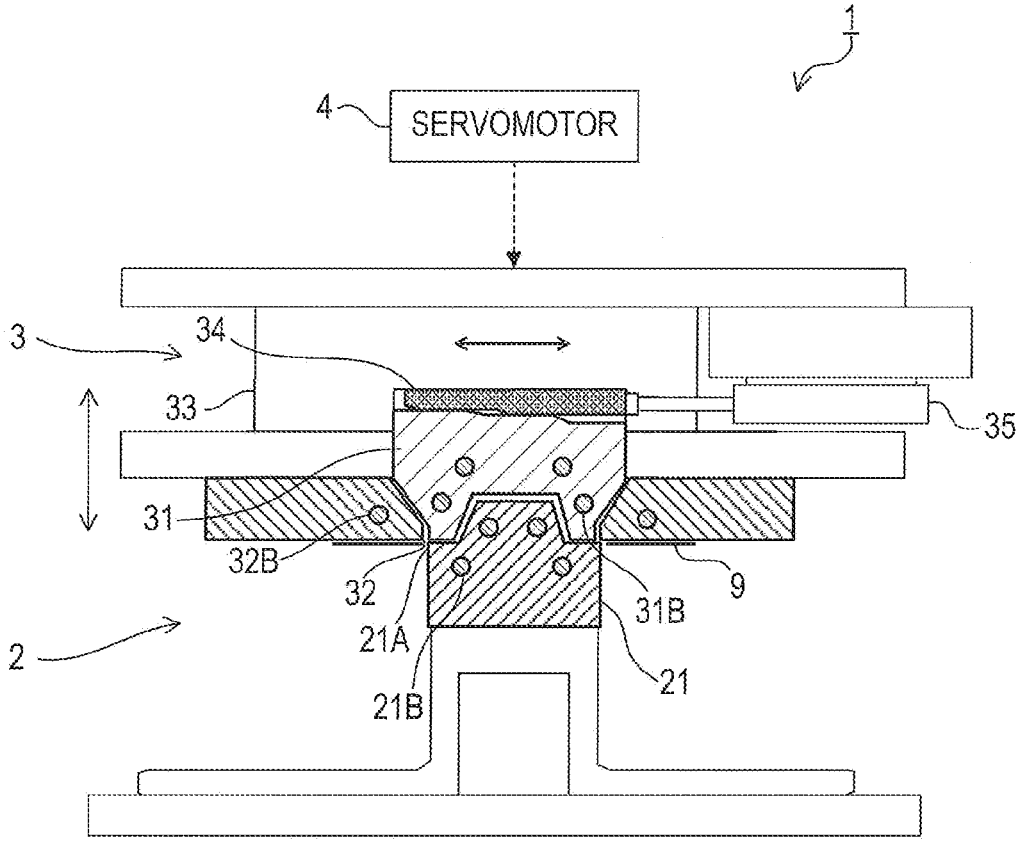
FIG. 1 is a diagram showing a configuration of a hot stamping device in a first state according to a first embodiment.

A hot stamping device 1 of the first embodiment shown in FIG. 1 is a device configured to perform hot stamping of a metal plate (iron sheet) 9 as a workpiece (an object to be processed). The hot stamping device 1 comprises: a fixed part 2; a movable part 3 provided movably in an up-and-down direction (movable in a vertical direction) with respect to the fixed part 2; and a servomotor 4 that generates power for enabling the up-and-down movement of the movable part 3. As the metal plate 9, for example, a Zn—Ni plated material is used.

The fixed part 2 comprises a lower die 21. In the lower die 21, a central portion of an upper surface thereof protrudes upwardly. A cross section of the lower die 21 when viewed from a lateral side thereof has a shape with a protruding center. The upper surface of the lower die 21 functions as a pressing surface that presses the metal plate 9 in a molding process (for example, drawing process and bending process). In addition, an outer-surface upper end 21A of the lower die 21 functions as a lower blade that cuts the metal plate 9 in a cutting-and-removing process (trimming and piercing process). Inside the lower die 21, a cooling water channel 21B for flowing cooling water is formed. The metal plate 9 is heated to a hardening temperature (for example, 900° C.) in a heating furnace at a stage prior to a process performed by the hot stamping device 1, and then processed by the hot stamping device 1 and cooled down.

The movable part 3 comprises a pad (upper die) 31, a cutting blade 32, a holder 33, a liner 34, and an automation equipment 35.

In the pad 31, a central portion of a lower surface thereof is depressed upwardly. A cross section of the pad 31 when viewed from a lateral side thereof has a shape in which such a depressed portion opens downwardly. The lower surface of the pad 31 functions as a pressing surface that presses (performs molding) the metal plate 9 in cooperation with the upper surface of the lower die 21 in the molding process. For this reason, the lower surface of the pad 31 is formed to have a shape that fits into the upper surface of the lower die 21. Inside the pad 31, a cooling water channel 31B for flowing cooling water is formed.

The cutting blade 32 is arranged such that the cutting blade 32 is located at outer sides of the pad 31. In the cutting-and-removing process, the cutting blade 32 functions as a lower blade that cuts the metal plate 9 in cooperation with the outer-surface upper end 21A of the lower die 21. Inside the cutting blade 32, a cooling water channel 32B for flowing cooling water is formed.

The holder 33 supports (secures) the cutting blade 32 at a lower position of the holder 33. Also, the holder 33 supports the pad 31 in a relatively movable manner in the up-and-down direction.

The liner 34 is disposed above the pad 31; the liner 34 abuts on an upper surface of the pad 31 so as to function as a restriction member that restricts a position of the pad 31 in the vertical direction with respect to the holder 33 (upwardly movable position). Formed on the upper surface of the pad 31 (surface on a side thereof facing to the liner 34) are a plurality of level differences in the form of a staircase (in the present embodiment, three level differences). Moreover, formed on a lower surface of the liner 34 (surface on a side thereof facing to the pad 31) are a plurality of level differences in the form of a staircase (in the present embodiment, two level differences), which fit into the level differences of the upper surface of the pad 31. The liner 34 is movably supported in the horizontal direction (left-and-right direction in FIG. 1) with respect to the pad 31. For this reason, depending on a position of the liner 34 in the horizontal direction, the upwardly movable position of the pad 31 with respect to the holder 33 can be changed.

The automation equipment 35 is supported by the holder 33; the automation equipment 35 generates power for moving the liner 34 in the horizontal direction to move the position of the liner 34 with respect to the pad 31, thereby changing an abutment state of the liner 34 with respect to the pad 31.

As shown in FIG. 1, in a first state where the liner 34 is inserted up to a deep point above the pad 31 (deep point to the left in FIG. 1), a relative position of the pad 31 with respect to the holder 33 is located below the holder 33 in the vertical direction. In this first state, the pad 31 is secured while being lowered, and therefore, the cutting blade 32 does not protrude toward the pad 31. The molding process is performed in this first state.

Figure 2:
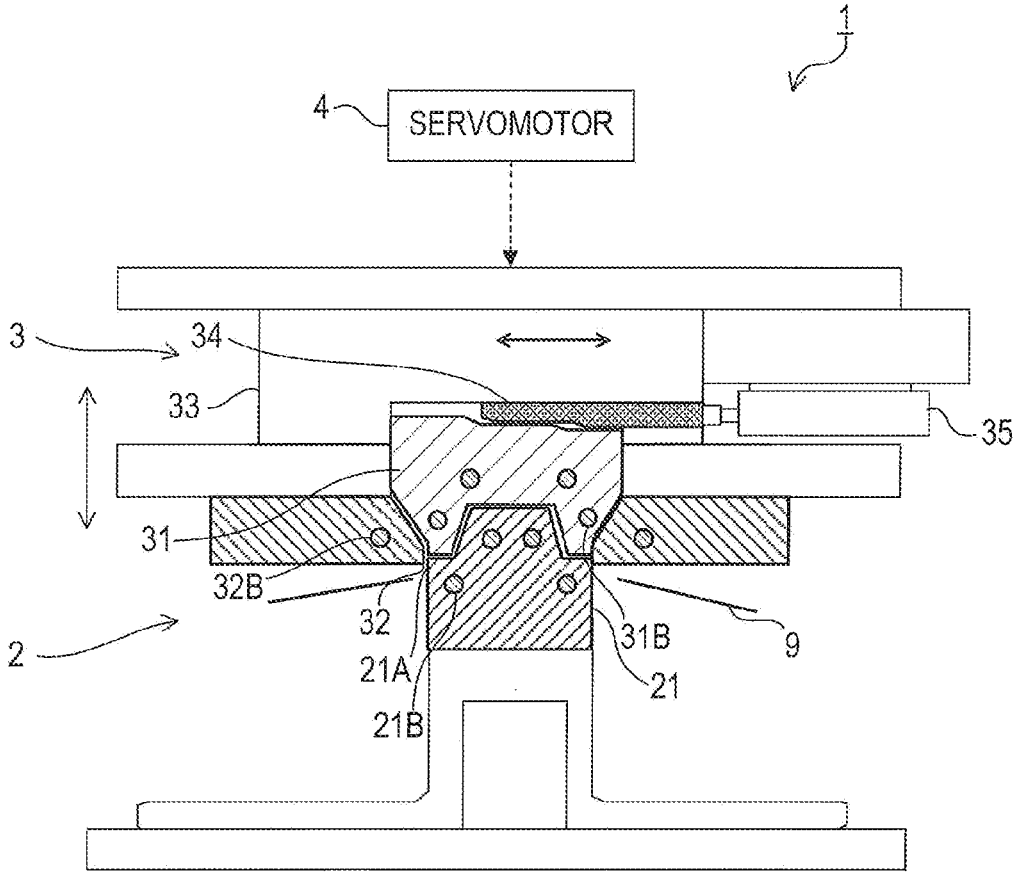
FIG. 2 is a diagram showing a configuration of the hot stamping device in a second state according to the first embodiment.

On the other hand, as shown in FIG. 2, in a second state where the liner 34 is retracted from the deep point above the pad 31 (deep point to the left in FIG. 2), the relative position of the pad 31 with respect to the holder 33 is located at an upper position in the vertical direction, compared with the first state (FIG. 1). In this second state, a position of the pad 31 is raised from the position of the pad 31 in the first state. Therefore, the cutting blade 32 for performing the cutting-and-removing process is exposed (protruded) below the lower surface of the pad 31. The cutting-and-removing process is performed in this second state.

Figure 3:
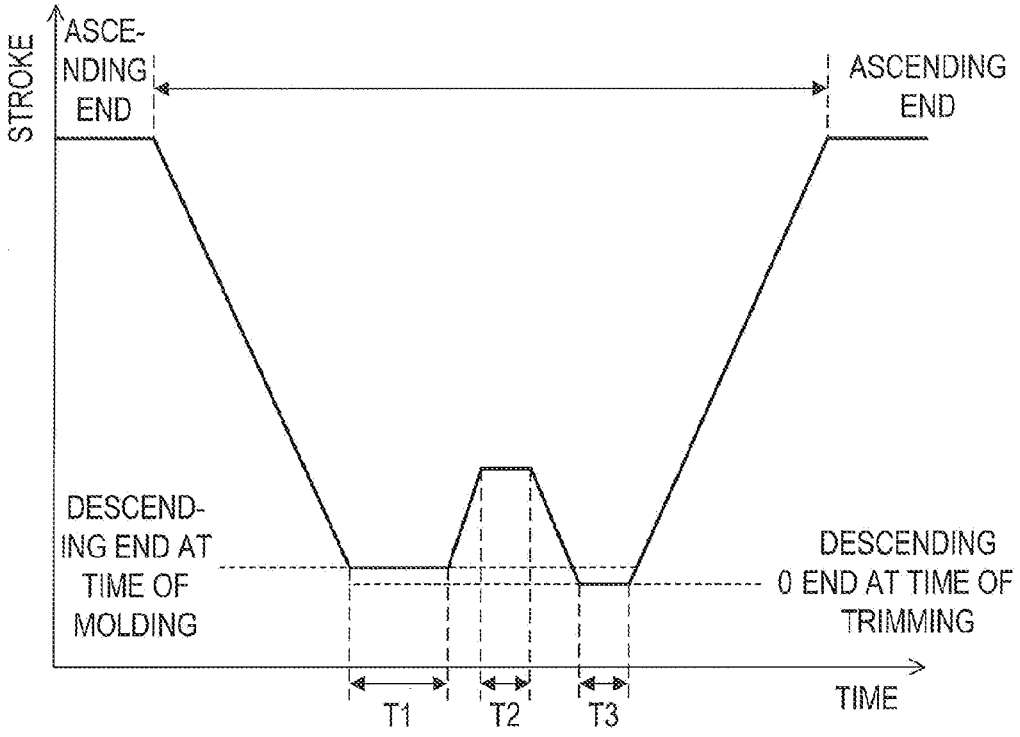
FIG. 3 is a view illustrating a sliding-operation motion in the first embodiment.

Next, explanations will be given with respect to a sliding-operation motion in the hot stamping device 1, with reference to FIG. 3.

In the first state, the pad 31 is lowered from an ascending end to a descending end at the time of the molding (state shown in FIG. 1); this state of the pad 31 is maintained for a holding time T1. Thereafter, the pad 31 is slightly raised. As a result of this movement, the molding process is performed.

Next, during a holding time T2, the pad 31 is maintained to be the state where the pad 31 is slighted raised. During the holding time T2, the automation equipment 35 operates to retract the liner 34 from the deep point above the pad 31, which leads to the second state.

Subsequently, the pad 31 is lowered to a descending end at the time of trimming (position that is lower than the descending end at the time of molding) (state shown in FIG. 2); this state of the pad 31 is maintained for a holding time T3. Thereafter, the pad 31 is raised to the ascending end. As a result of this movement, the cutting-and-removing process is performed.

According to the above-described first embodiment, the following effects can be obtained.

Figure 4:
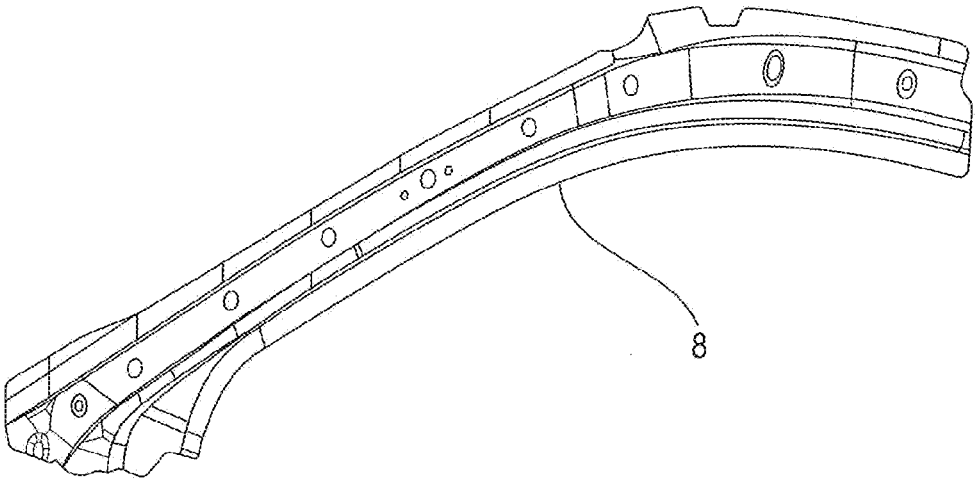
FIG. 4 is a view showing an appearance of a part to be manufactured.

[A1] The hot stamping device 1 comprises: the lower die 21; the holder 33 that is movable relative to the lower die 21 in the vertical direction; the pad 31 that is supported by the holder 33 and that performs the molding process on the metal plate 9 in cooperation with the lower die 21; the cutting blade 32 that is supported by the holder 33 and that performs the cutting-and-removing process on the metal plate 9 in cooperation with the lower die 21; and the liner 34 and the automation equipment 35, which can change, in a stepwise manner, a relative position of the pad 31 with respect to the cutting blade 32 in the vertical direction. That is to say, the molding process and the cutting-and-removing process are switched, thereby performing hot stamping. For example, when a part 8 shown in FIG. 4 is manufactured, the molding process and the cutting-and-removing process can be completed as one cycle. Therefore, for example, comparing with a case of the cutting-and-removing process by a laser, such a process can be performed for a short period of time. In addition, a delayed fracture can be made less likely to occur.

[A2] In each of the upper surface of the pad 31 and the lower surface of the liner 34, the plurality of level differences in the form of a staircase are formed. Thus, for example, a protruding amount of the cutting blade 32 can be changed among a plurality of levels, or the molding process can be performed in a plurality of levels.

[A3] By changing the abutment state of the liner 34 with respect to the pad 31, a relative position of the pad 31 with respect to the cutting blade 32 can be changed in a stepwise manner. Thus, compared with a configuration in which the liner 34 is returned to the original position after being completely separated from the pad 31, interference at the time of sliding can be inhibited and the position of the liner 34 with respect to the pad 31 can be easily changed. In addition, a moving amount of the liner 34 can be made small (stroke can be short). Accordingly, this enables downsizing of the device.

[A4] The level differences are formed on both of the surface on the side of the liner 34, which faces to the pad 31, and the surface on the side of the pad 31, which faces to the liner 34. Thus, the abutment state of the pad 31 and the liner 34 can be made stable.

In the first embodiment, the lower die 21 corresponds to one example of a first die; the pad 31 corresponds to one example of a second die; the cutting blade 32 corresponds to one example of a cutting member; and the holder 33 corresponds to one example of a movable body. Moreover, the liner 34 and the automation equipment 35 correspond to one example of a switching unit; the liner 34 corresponds to one example of a restriction member; and the automation equipment 35 corresponds to one example of a driving unit. Furthermore, the metal plate 9 corresponds to one example of a metallic material; and the vertical direction corresponds to one example of an approaching-and-separating direction.

Second Embodiment

Figure 5:
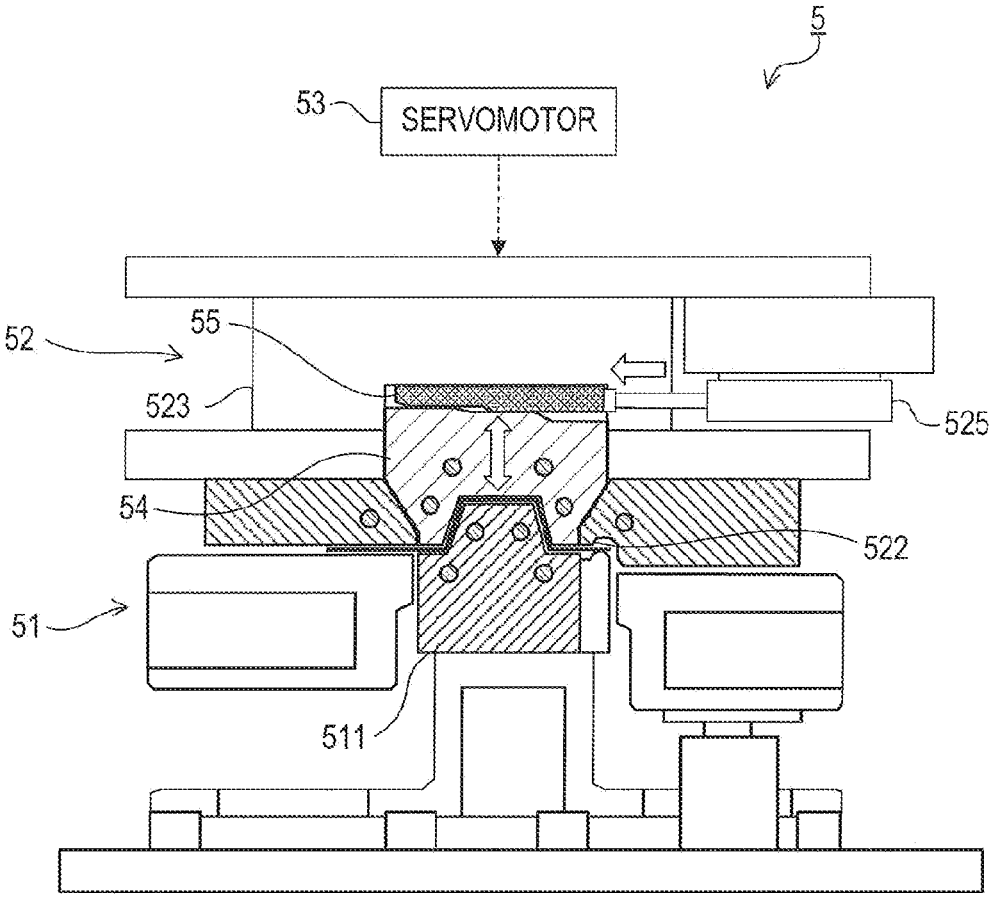
FIG. 5 is a diagram showing a configuration of a hot stamping device of in a first state according to a second embodiment.
Figure 6:
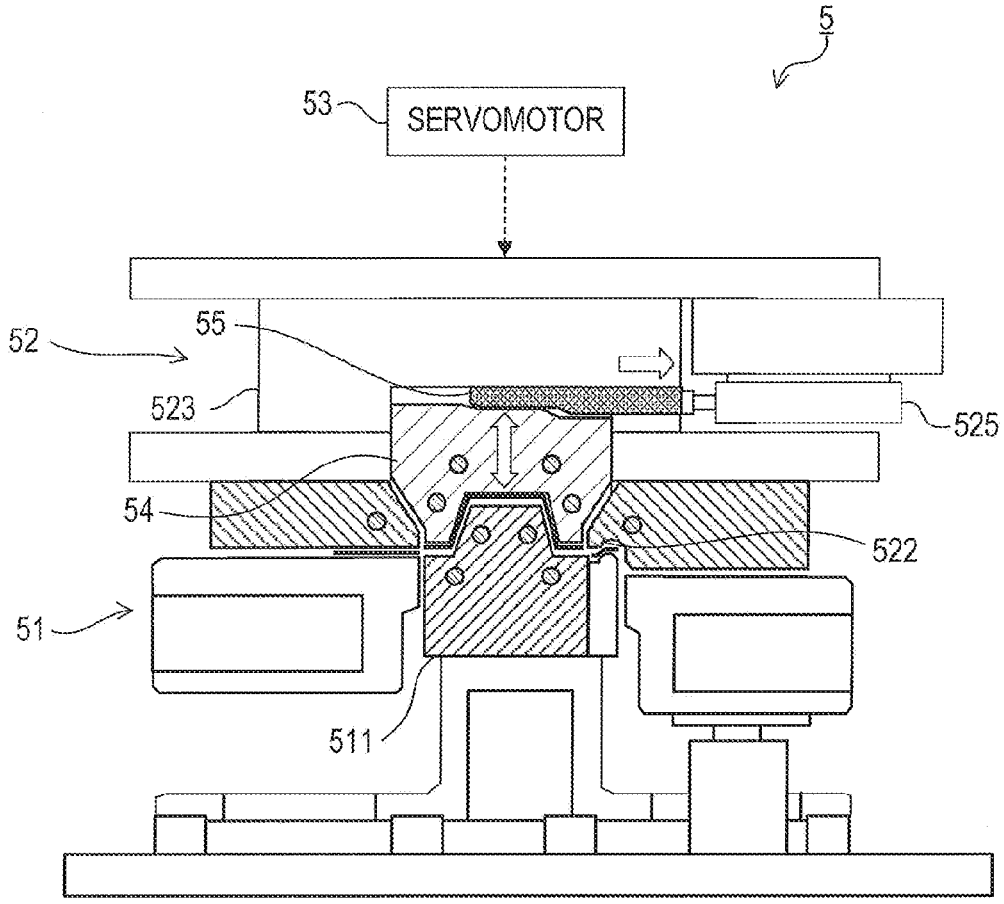
FIG. 6 is a diagram showing a configuration of the hot stamping device in a second state according to the second embodiment.

A hot stamping device 5 of the second embodiment shown in FIGS. 5 and 6 comprises a fixed part 51, a movable part 52, and a servomotor 53, as in the hot stamping device 1 of the first embodiment. The fixed part 51 comprises a lower die 511, as in the first embodiment. The movable part 52 comprises a pad 54, a cutting blade 522, a holder 523, a liner 55, and an automation equipment 525, as in the first embodiment.

Figure 7A:
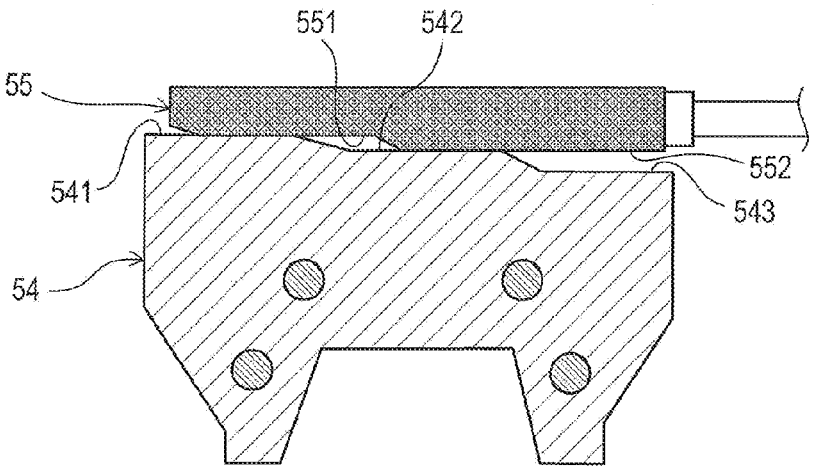
FIG. 7A is a partial enlarged view of the hot stamping device in the first state according to the second embodiment.

Specifically, as shown in FIG. 7A, formed on an upper surface of the pad 54 (surface on a side thereof facing to the liner 55) are a first pad surface 541, a second pad surface 542, and a third pad surface 543. The first pad surface 541 protrudes toward the liner 55 (upwardly), compared with the second pad surface 542. The second pad surface 542 protrudes toward the liner 55 (upwardly), compared with the third pad surface 543. In this embodiment, a level difference from the second pad surface 542 to the third pad surface 543 and a level difference from the first pad surface 541 to the second pad surface 542 are designed to be equal to each other. Here, if a position of the upper surface of the pad 54 is unchanged, the more this upper surface protrudes toward the liner 55, the lower the position of a lower surface (processing surface) of the pad 54.

On the other hand, formed on a lower surface of the liner 55 (surface on a side thereof facing to the pad 54) are a first liner surface 551 and a second liner surface 552. The second liner surface 552 protrudes toward the pad 54, compared with the first liner surface 551. In this embodiment, a level difference from the first liner surface 551 to the second liner surface 552 is designed to be equal to the level differences on the upper surface of the pad 54. Here, the more a portion in the lower surface of the liner 55, which is configured to abut on the upper surface of the pad 54, protrudes toward the pad 54, the lower the position of the lower surface of the pad 54 (processing surface).

As shown in FIG. 7A, in a first state where the liner 55 is inserted up to a deep point above the pad 54 (deep point to the left in FIG. 7A), the first pad surface 541 and the first liner surface 551 abut on each other, and the second pad surface 542 and the second liner surface 552 abut on each other. In this first state, the pad 54 is fixed while being lowered, and therefore, the cutting blade 522 does not protrude toward the pad 54. The molding process is performed in this first state.

Figure 7B:
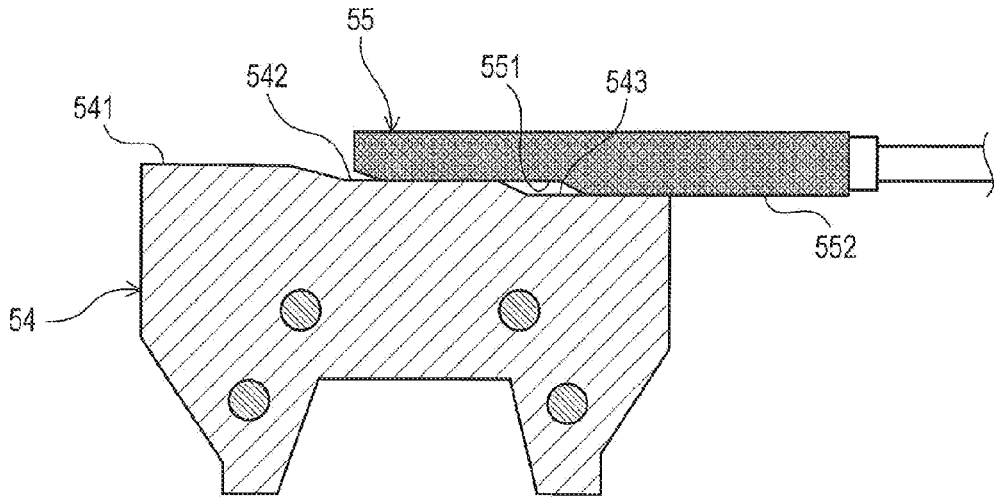
FIG. 7B is a partial enlarged view of the hot stamping device in the second state according to the second embodiment.

On the other hand, as shown in FIG. 7B, in a second state where the liner 55 is retracted from the deep point above the pad 54, the second pad surface 542 and the first liner surface 551 abut on each other, and the third pad surface 543 and the second liner surface 552 abut on each other. For this reason, in the second state, compared with the first state, a relative position of the pad 54 with respect to the holder 523 is located above the holder 523 in the vertical direction. In this second state as above, a position of the pad 54 is raised from the position of the pad 54 in the first state. Therefore, the cutting blade 522 for performing the cutting-and-removing process is exposed (protruded) below the lower surface of the pad 54. The cutting-and-removing process is performed in this second state.

According to the second embodiment described as above, the same effects as those in the first embodiment can be obtained.

In the second embodiment, the lower die 511 corresponds to one example of the first die; the pad 54 corresponds to one example of the second die; the cutting blade 522 corresponds to one example of the cutting member; and the holder 523 corresponds to one example of the movable body. Moreover, the liner 55 and the automation equipment 525 correspond to one example of the switching unit; the liner 55 corresponds to one example of the restriction member; and the automation equipment 525 corresponds to one example of the driving unit. Furthermore, the vertical direction corresponds to one example of the approaching-and-separating direction.

Third Embodiment

Figure 8:
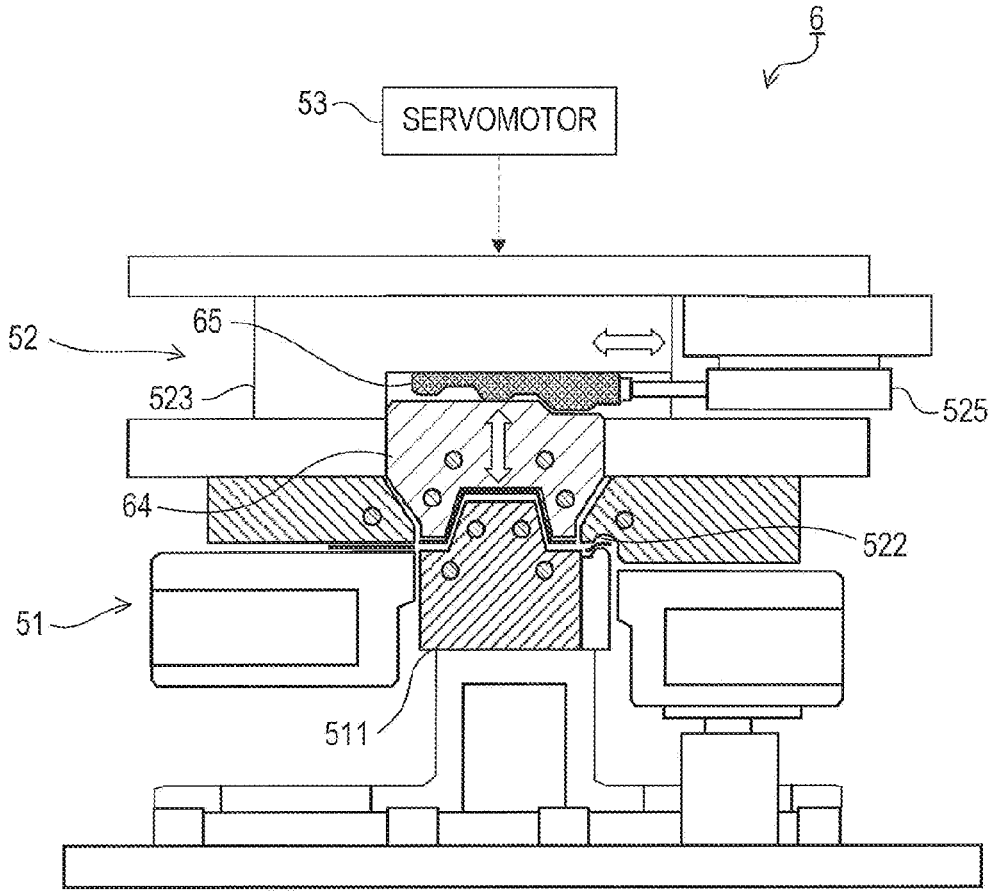
FIG. 8 is a diagram showing a configuration of a hot stamping device in a second state according to a third embodiment.
Figure 9A:
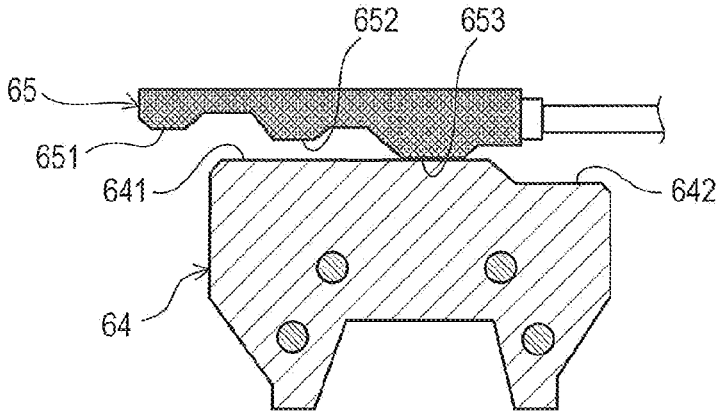
FIG. 9A is a partial enlarged view of the hot stamping device in a first state according to the third embodiment.

A hot stamping device 6 of the third embodiment shown in FIG. 8 basically has the same configuration as that of the hot stamping device 5 in the second embodiment, but has a difference in which the hot stamping device 6 comprises a pad 64 and a liner 65, which are shown in FIG. 8, FIG. 9A, etc., instead of the pad 54 and the liner 55 in the second embodiment.

As shown in FIG. 9A, formed on an upper surface of the pad 64 (surface on a side thereof facing to the liner 65) are a first pad surface 641 and a second pad surface 642. The first pad surface 641 protrudes toward the liner 65 (upwardly), compared with the second pad surface 642.

On the other hand, formed on a lower surface of the liner 65 (surface on a side thereof facing to the pad 64) are a first liner surface 651, a second liner surface 652, and a third liner surface 653. The second liner surface 652 protrudes toward the pad 64, compared with the first liner surface 651. The third liner surface 653 protrudes toward the pad 64, compared with the first liner surface 652. In this embodiment, a level difference from the second liner surface 652 to the third liner surface 653 and a level difference from the first liner surface 651 to the second liner surface 652 are designed to be smaller than a level difference from the first pad surface 641 to the second pad surface 642.

As shown in FIG. 9A, in a first state where the liner 65 is inserted up to a deep point above the pad 64 (deep point to the left in FIG. 9A), the first pad surface 641 and the third liner surface 653 abut on each other. In this first state, the pad 64 is fixed while being lowered, and therefore, the cutting blade 522 does not protrude toward the pad 64. The molding process is performed in this first state.

Figure 9B:
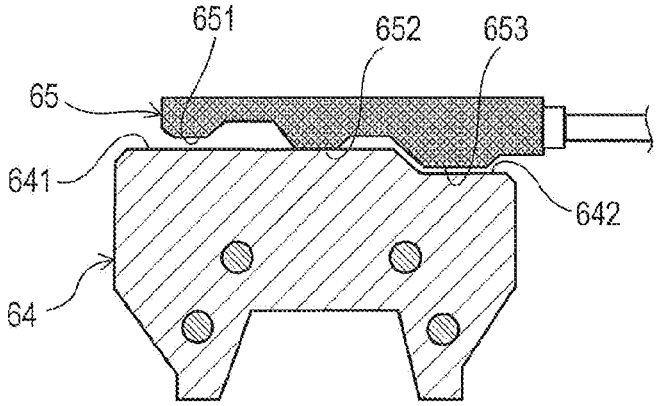
FIG. 9B is a partial enlarged view of the hot stamping device in the second state according to the third embodiment.

Moreover, as shown in FIG. 9B, in a second state where the liner 65 is moved back by one step (one pitch) from the deep point above the pad 64, the first pad surface 641 and the second liner surface 652 abut on each other. For this reason, in the second state, compared with the first state, a relative position of the pad 64 with respect to the holder 523 is located above the holder 523 in the vertical direction. In this second state, a position of the pad 64 is raised from the position of the pad 64 in the first state. Therefore, the cutting blade 522 for performing the cutting-and-removing process is exposed (protruded) below the lower surface of the pad 64. The cutting-and-removing process is performed in this second state.

Figure 9C:
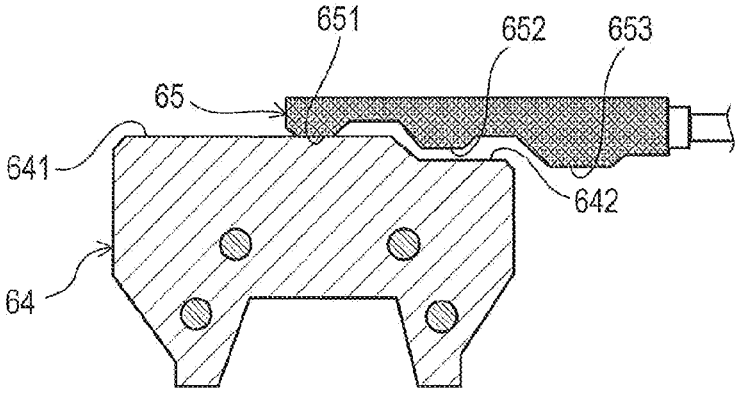
FIG. 9C is a partial enlarged view of the hot stamping device in a third state according to the third embodiment.

Moreover, as shown in FIG. 9C, in a third state where the liner 65 is further moved back by one step from the deep point above the pad 64, the first pad surface 641 and the first liner surface 651 abut on each other. For this reason, in the third state, compared with the second state, the relative position of the pad 64 with respect to the holder 523 is located further above the holder 523 in the vertical direction. In this third state, the position of the pad 64 is further raised than the position of the pad 64 in the second state, and metal stamp tools come out thereby to stamp a mark.

According to the third embodiment described as above, the same effects as those in the second embodiment can be obtained. Especially, according to the third embodiment, the relative position of the pad 64 with respect to the cutting blade 522 in the vertical direction can be changed among three levels, thereby enabling to complete a more complex process in a short period of time. Specifically, according to the third embodiment, the molding process and the cutting-and-removing process, and also stamping of a mark can be all completed in one cycle. Moreover, presence or absence of a stamp can be changed depending on types of parts, etc.

In this regard, instead of the presence or absence of a stamp, a number of holes to be formed, presence or absence of partial bending, etc. may be changed. In the third embodiment, the pad 64 corresponds to one example of the second die; the liner 65 and the automation equipment 525 correspond to one example of the switching unit; and the liner 65 corresponds to one example of the restriction member.

Fourth Embodiment

Figure 10:
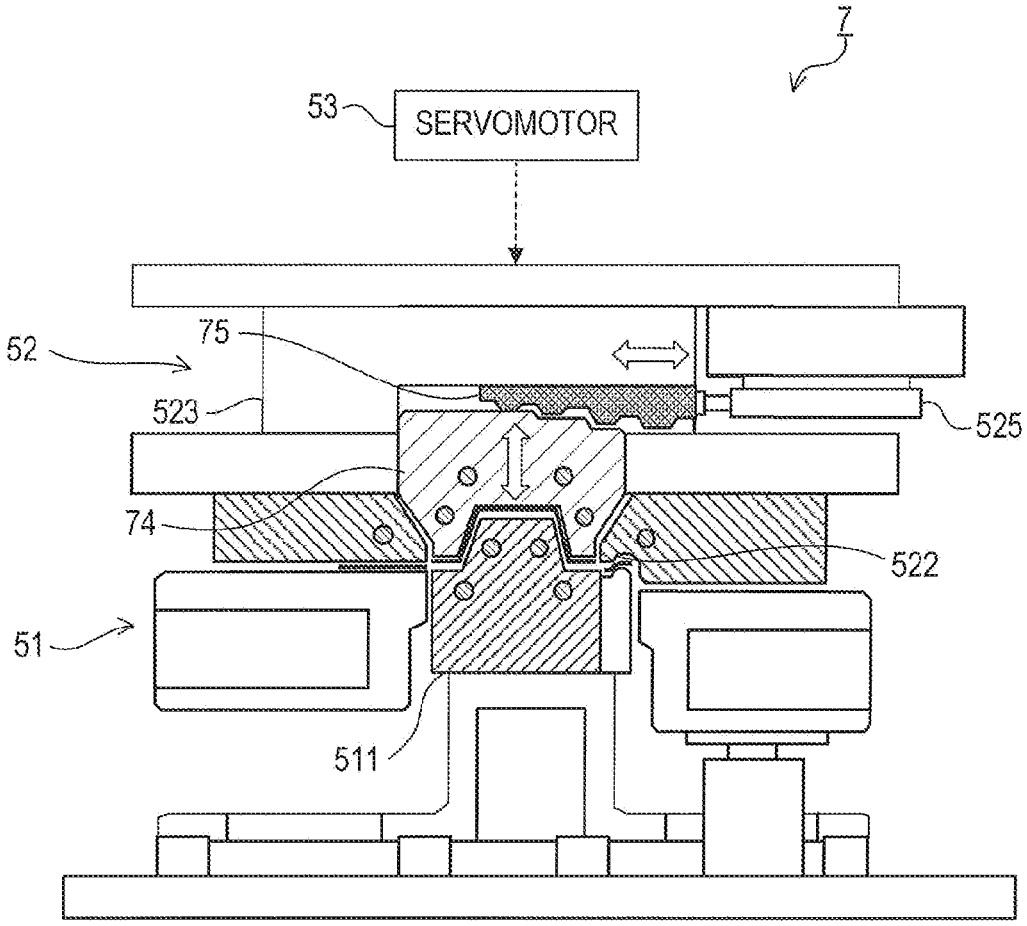
FIG. 10 is a diagram showing a configuration of a hot stamping device in a fourth state according to a fourth embodiment.
Figure 11A:
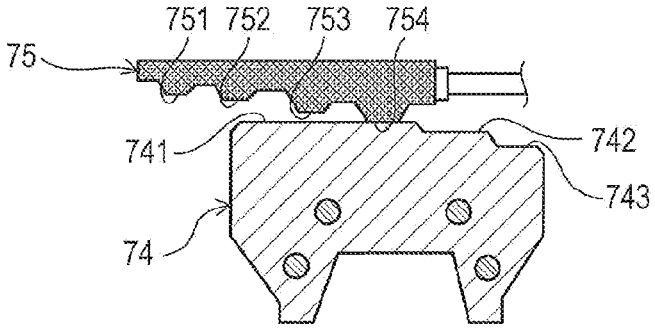
FIG. 11A is a partial enlarged view of the hot stamping device in a first state according to the fourth embodiment.

A hot stamping device 7 of the fourth embodiment shown in FIG. 10 basically has the same configuration as that of the hot stamping device 5 in the second embodiment, but has a difference in which the hot stamping device 7 comprises a pad 74 and a liner 75 shown in FIGS. 10, 11A, etc., instead of the pad 54 and the liner 55 in the second embodiment.

As shown in FIG. 11A, formed on an upper surface of the pad 74 (surface on a side thereof facing to the liner 75) are a first pad surface 741, a second pad surface 742, and a third pad surface 743. The first pad surface 741 protrudes toward the liner 75 (upwardly), compared with the second pad surface 742. The second pad surface 742 protrudes toward the liner 75 (upwardly), compared with the third pad surface 743. In this embodiment, a level difference from the second pad surface 742 to the third pad surface 743 and a level difference from the first pad surface 741 to the second pad surface 742 are designed to be equal to each other.

On the other hand, formed on a lower surface of the liner 75 (surface on a side thereof facing to the pad 74) are a first liner surface 751, a second liner surface 752, a third liner surface 753, and a fourth liner surface 754. The second liner surface 752 protrudes toward the pad 74, compared with the first liner surface 751. The third liner surface 753 protrudes toward the pad 74, compared with the second liner surface 752. The fourth liner surface 754 protrudes toward the pad 74, compared with the third liner surface 753. In this embodiment, a level difference from the third liner surface 753 to the fourth liner surface 754, a level difference from the second liner surface 752 to the third liner surface 753, and a level difference from the first liner surface 751 to the second liner surface 752 are designed to be smaller than the level differences on the upper surface of the pad 74.

As shown in FIG. 11A, in a first state where the liner 75 is inserted up to a deep point above the pad 74 (deep point to the left in FIG. 11A), the first pad surface 741 and the fourth liner surface 754 abut on each other. In the first state as above, the pad 74 is fixed while being lowered, and therefore, the cutting blade 522 does not protrude toward the pad 74. The molding process is performed in this first state.

Figure 11B:
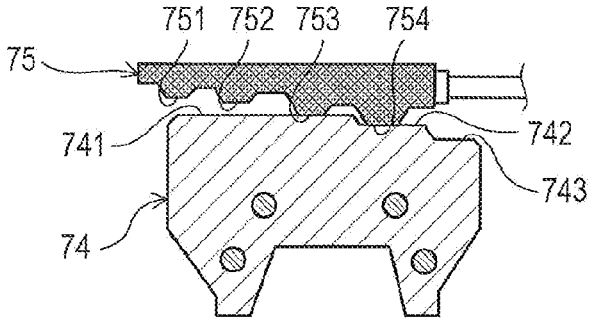
FIG. 11B is a partial enlarged view of the hot stamping device in a second state according to the fourth embodiment.

Moreover, as shown in FIG. 11B, in a second state where the liner 75 is moved back by one step (one pitch) from the deep point above the pad 74, the first pad surface 741 and the third liner surface 753 abut on each other. For this reason, in the second state, compared with the first state, a relative position of the pad 74 with respect to the holder 523 is located above the holder 523 in the vertical direction. In the second state as above, a position of the pad 74 is raised from the position of the pad 74 in the first state. Therefore, the cutting blade 522 for performing the cutting-and-removing process is exposed (protruded) below the lower surface of the pad 74. The cutting-and-removing process is performed in this second state.

Figure 11C:
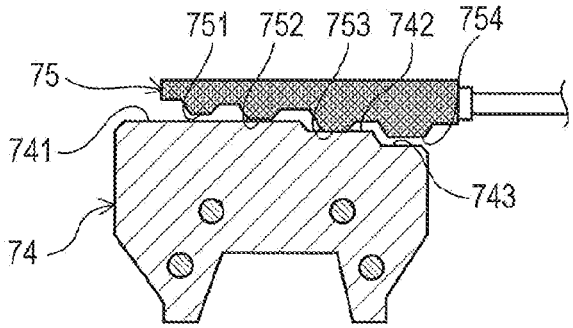
FIG. 11C is a partial enlarged view of the hot stamping device in a third state according to the fourth embodiment.

Furthermore, as shown in FIG. 11C, in a third state where the liner 75 is further moved back by one step from the deep point above the pad 74, the first pad surface 741 and the second liner surface 752 abut on each other. For this reason, in the third state, compared with the second state, the relative position of the pad 74 with respect to the holder 523 is located further above the holder 523 in the vertical direction. In the third state as above, the position of the pad 74 is further raised than the position of the pad 74 in the second state, and a punch comes out to perform a hole punching process.

Figure 11D:
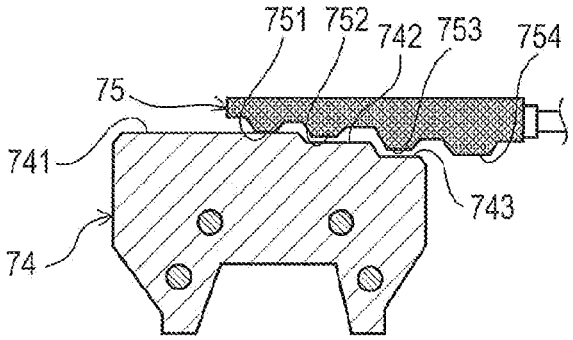
FIG. 11D is a partial enlarged view of the hot stamping device in the fourth state according to the fourth embodiment.

Moreover, as shown in FIG. 11D, in a fourth state where the liner 75 is still further moved back by one step from the deep point above the pad 74, the first pad surface 741 and the first liner surface 751 abut on each other. For this reason, in the fourth state, compared with the third state, the relative position of the pad 74 with respect to the holder 523 is located still further above the holder 523 in the vertical direction. In the fourth state as above, the position of the pad 74 is further raised from the position of the pad 74 in the third state, and metal stamp tools come out thereby to stamp a mark.

According to the fourth embodiment described as above, the same effects as those in the second embodiment can be obtained. Especially, according to the fourth embodiment, the relative position of the pad 74 with respect to the cutting blade 522 in the vertical direction can be changed among four levels, thereby enabling to complete a more complex process in a short period of time. Specifically, according to the fourth embodiment, the molding process and the cutting-and-removing process, and also the hole punching process and the stamping of a mark can be all completed in one cycle. Also, a number of holes, and presence or absence of a stamp can be changed depending on types of parts, etc.

Here, instead of the number of holes and the presence or absence of a stamp, presence or absence of partial bending, etc. can be changed. Moreover, in the fourth embodiment, the pad 74 corresponds to one example of the second die, the liner 75 and the automation equipment 525 correspond to one example of the switching unit, and the liner 75 corresponds to one example of the restriction member.

Other Embodiments

Embodiments of the present invention have been described as above. However, needless to say, the present invention should not be limited to the above-described embodiments, and various modifications can be made to the present invention.

Figure 12:
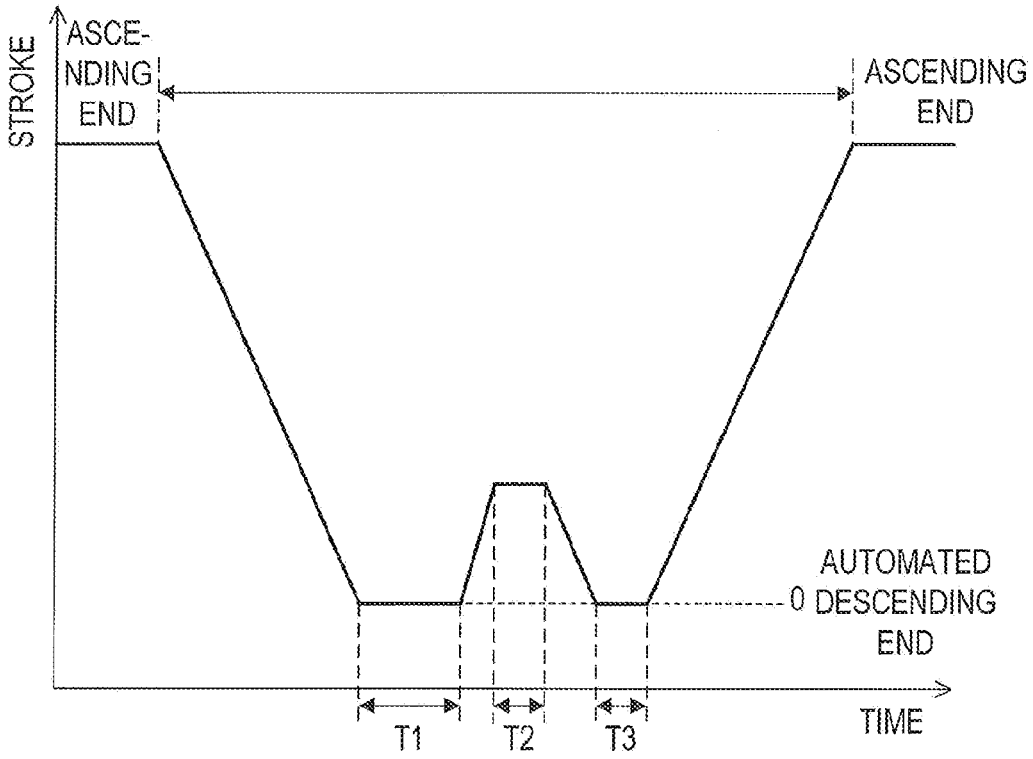
FIG. 12 is a view illustrating a sliding-operation motion in a first modified example.
Figure 13:
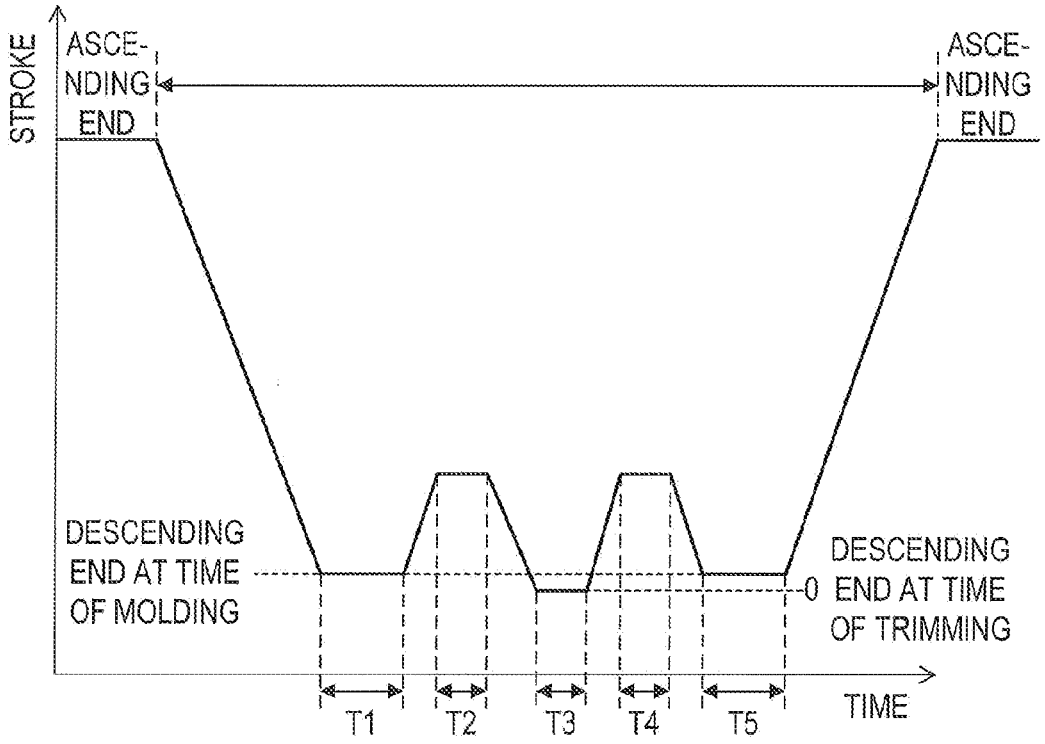
FIG. 13 is a view illustrating a sliding-operation motion in a second modified example.

[B1] The sliding-operation motion (FIG. 3) described in the above-described embodiments is just one example, and it should not be limited to this motion. For example, as shown in FIG. 12, it may be configured such that the descending end is made to be constant in a plurality of strokes. Also, as shown in FIG. 13, the stroke can be performed for more than three times. FIG. 13 shows an example of performing a molding process subsequent to the molding process and the cutting-and-removing process; however, an order of these processes can be order others. Moreover, a mechanism to switch shapes of the upper die should not be limited to the one illustrated in the above-described embodiments, but can be carried out by various mechanisms.

[B2] Each component in the present invention is a conceptual component, and should not be limited to the above-described embodiments. For example, a function of one component may be divided and assigned to multiple components. Alternatively, functions of multiple components may be consolidated and assigned to a single component. Moreover, at least part of the configuration of the above-described embodiments may be replaced with a known configuration having the same function.

The invention claimed is:

1. A hot stamping device for performing hot stamping of a metallic material, the hot stamping device comprising:

a first die;

a movable body that is relatively movable to the first die in an approaching-and-separating direction;

a second die that is supported by the movable body and that performs a molding process on the metallic material in cooperation with the first die;

a cutting member that is supported by the movable body and that performs a cutting-and-removing process on the metallic material in cooperation with the first die; and a switching unit that is capable of switching in a stepwise manner a relative position of the second die with respect to the cutting member in the approaching-and-separating direction, wherein the switching unit comprises:

a restriction member that abuts on the second die and that restricts a position of the second die with respect to the movable body in the approaching-and-separating direction; and a driving unit that changes a position of the restriction member with respect to the second die, and that switches an abutment state of the restriction member with respect to the second die among a plurality of abutment states;

wherein a plurality of level differences is formed on at least one of a surface on a side of the restriction member, the side of the restriction member facing to the second die, and a surface on a side of the second die, the side of the second die facing to the restriction member; and wherein the restriction member comprises: a first horizontal restriction surface arranged to abut on the second die in a first abutment state providing a first relative position between the second die and the movable body in the approaching-and-separating direction, a second horizontal restriction surface arranged to abut on the second die in a second abutment state providing a second relative position between the second die and the movable body in the approaching-and-separating direction, and a third horizontal restriction surface arranged to abut on the second die in a third abutment state providing a third relative position between the second die and the movable body in the approaching-and-separating direction, wherein the first, second, and third relative positions differ from one another.

2. The hot stamping device according to claim 1, wherein the switching unit is capable of switching the relative position of the second die with respect to the cutting member in the approaching-and-separating direction, among more than three levels.

3. The hot stamping device according to claim 1, wherein each level difference is formed on both of the surface on the side of the restriction member, the side of the restriction member facing to the second die, and the surface on the side of the second die, the side of the second die facing to the restriction member.

4. The hot stamping device according to claim 2, wherein the molding process and the cutting-and-removing process are performed in one or more of:

the first abutment state;

the second abutment state; or the third abutment state.

5. The hot stamping device according to claim 4, wherein on the surface on the side of the second die, the side of the second die facing to the restriction member, a first facing surface and a second facing surface, which have different positions from each other in the approaching-and-separating direction, are formed, and wherein a first level difference formed by the first horizontal restriction surface and the second horizontal restriction surface and a second level difference formed by the second horizontal restriction surface and the third horizontal restriction surface are smaller than a level difference formed by the first facing surface and the second facing surface.

6. The hot stamping device according to claim 4, further comprising stamping of a mark, wherein said stamping of a mark is performed in one or more of:

a first state in which the first horizontal restriction surface abuts on a specified surface of the second die;

a second state in which the second horizontal restriction surface abuts on a specified surface of the second die; or a third state in which the third horizontal restriction surface abuts on a specified surface of the second die.

7. The hot stamping device according to claim 1, wherein the restriction member comprises a first angled surface between the first horizontal restriction surface and the second horizontal restriction surface, and comprises a second angled surface between the second horizontal restriction surface and the third horizontal restriction surface.

* * * * *